US006283555B1

(12) United States Patent
Arai et al.

(10) Patent No.: US 6,283,555 B1
(45) Date of Patent: Sep. 4, 2001

(54) PLASMA BLASTING WITH COAXIAL ELECTRODES

(75) Inventors: Hiroaki Arai, Osaka; Hidehiko Maehata, Suita, both of (JP)

(73) Assignee: Hitachi Zosen Corporation (JP)

( * ) Notice: Subject to any disclaimer, the term of this patent is extended or adjusted under 35 U.S.C. 154(b) by 0 days.

(21) Appl. No.: 09/498,658

(22) Filed: Feb. 7, 2000

Related U.S. Application Data

(63) Continuation-in-part of application No. 09/011,205, filed as application No. PCT/JP96/02061 on Jul. 22, 1911.

(30) Foreign Application Priority Data

Jul. 24, 1995 (JP) ..... 7-186101
Jul. 24, 1995 (JP) ..... 7-186102

(51) Int. Cl.[7] ..... E21C 37/14; E21C 37/18
(52) U.S. Cl. ..... 299/14; 175/16
(58) Field of Search ..... 299/14, 16; 175/16; 241/1; 102/325, 327, 326

(56) References Cited

U.S. PATENT DOCUMENTS

| | | |
|---|---|---|
| 3,679,007 | 7/1972 | O'Hare . |
| 4,479,680 | 10/1984 | Wesley et al. . |
| 4,653,697 | 3/1987 | Codina . |
| 5,106,164 | 4/1992 | Kitzinger et al. . |
| 5,425,570 | 6/1995 | Wilkinson . |
| 5,482,357 | 1/1996 | Wint et al. . |

FOREIGN PATENT DOCUMENTS 7-145698 6/1995 (JP) ..... E21C/37/00

OTHER PUBLICATIONS

Rustan, A. (ed.) Rock Blasting Terms and Symbols, 1998, p. 120.

Kutter, H. The Electrohydraulic Effect: Potential Application in Rock Fragmentation, 1969, p. 1–135.

*Primary Examiner*—David Bagnell
*Assistant Examiner*—John Kreck
(74) *Attorney, Agent, or Firm*—D. Peter Hochberg; Katherine R. Vieyra; William H. Holt

(57) ABSTRACT

A discharge breaking system and a discharge breaking method for breakage and decomposition of objects to be ruptured such as destruction of base rocks and breakage of stones into small pieces at building lands, breakage for finishing tunnels and destruction of concrete buildings. A discharge breaking system is configured to supply or discharge electric energy charged or accumulated in a capacitor between a pair of electrodes in a short time for abrupt vaporization of a breaking substance for transmitting a pressure, thereby breaking an object to be ruptured with an expansion force generated by the vaporization. The discharge breaking systems has a structure wherein an end portion of a sheath member which covers a pair of metal cores for composing a cable is cut off to expose ends of the metal cores, and the exposed ends of the metal cores are submerged in the breaking substance and used as electrodes. The cable can be a coaxial cable having an inner core and an outer core, the cable being cut off to expose an end of the inner cable having one or more notches to cause the exposed end of the inner core to function as the foregoing thin metal wire. This discharge breaking system requires no adjustment of a distance between the electrodes and can easily be manufactured.

7 Claims, 10 Drawing Sheets

PLASMA BLASTING WITH COAXIAL ELECTRODES

CROSS REFERENCE TO RELATED APPLICATION

This application is a continuation-in-part of corresponding U.S. patent application Ser. No. 09/011,205 filed Jan. 23, 1998 which is a 371 of PCT/JP96/02061 filed Jul. 22, 1996.

FIELD OF THE INVENTION

The present invention relates to an electric discharge breaking system and a discharge breaking method using energy produced by electric discharge.

BACKGROUND ART

There is conventionally known a discharge breaking system which is used for breaking concrete buildings and rocks with energy produced by electric discharge.

This discharge breaking system comprises a breaking container which is to be fitted into a charging hole formed in an object to be ruptured and a pair of electrodes which have ends submerged in a breaking substance. for transmitting a pressure filled in the breaking container.

Water, for example, is used as the breaking substance and the electrodes are shaped, for example, in a rod-like or sheet-like form.

A discharge breaking method using this discharge breaking system comprises steps: to form a charging hole in an object to be ruptured, to fit the breaking container into this charging hole, to charge or accumulate electric energy in a capacitor connected between the other ends of the electrodes and to supply or discharge the electric energy between the electrodes in a short time for abruptly vaporizing the breaking substance, thereby breaking the object to be ruptured with an expansion force produced by the vaporization.

Since the discharge breaking system described above is configured to allow electric discharge to take place between a pair of electrodes, it requires a delicate setting of a distance between the electrodes for locating the electric discharge and a delicate setting of a quantity of electric energy to be charged or accumulated in the capacitor.

Further, the discharge breaking system has a defect that it requires a high manufacturing cost since a pair of particular electrodes must be prepared for manufacturing the destruction system.

Another example of discharge breaking system will be described below. This discharge breaking system has a structure wherein a thin metal wire is welded or soldered across ends of a pair of electrodes for electrically connecting the electrodes to each other, the electrodes are inserted into a breaking container for submerging the thin metal wire into a breaking substance filled in the breaking container, the electrodes pass through a sealing stopper to be fitted into an aperture of the breaking container and a capacitor is connected between the other ends of the electrodes.

A discharge breaking method using this discharge breaking system comprises steps to supply electric energy charged or accumulated in the capacitor to the thin metal wire in a short time for abrupt fusing-vaporization of the thin metal wire and vaporization of the breaking substance, thereby breaking an object to be ruptured with an expansion force generated by the vaporization.

The discharge breaking system mentioned as the latter example requires tedious procedures and a high cost for manufacturing since it is necessary for manufacturing this destruction system to prepare a pair of electrodes and weld a thin metal wire across ends of these electrodes. Further, this discharge breaking system has another defect that it has a complicated structure as a whole.

Accordingly, a primary object of the present invention is to provide a discharge breaking system which is free from the defects described above.

DISCLOSURE OF THE INVENTION

A first discharge breaking system according to the present invention is configured to abruptly vaporize a breaking substance for transmitting a pressure by supplying or discharging electric energy charged or accumulated in a capacitor between electrodes in a short time and break an object to be ruptured with an expansion force generated by the vaporization; and has a structure wherein ends of a plurality of metal cores are exposed by cutting off an end portion of a sheath member of a cable which is composed of the metal cores disposed in parallel with each other and covered with the sheath member, submerged in the breaking substance and used as electrodes.

Further, a second discharge breaking system according to the present invention is configured to abruptly vaporize a breaking substance for transmitting a pressure by supplying or discharging electric energy charged or accumulated in a capacitor between electrodes in a short time and break an object to be ruptured with an expansion force generated by the vaporization; and has a structure wherein ends of an inner metal core and an outer metal core are exposed by cutting off an end portion of a sheath member of a coaxial cable composed of the inner core and the outer core which are coaxially disposed and covered with the sheath member, submerged into the breaking substance and used as electrodes.

The discharge breaking method according to the present invention which is to be used for breaking an object to be ruptured with the discharge breaking system described above is configured for setting relationship of a distance L (mm) between the electrodes submerged in the breaking substance versus a voltage Vp to be applied between the electrodes so as to satisfy the following equation:

$$Vp \geqq 1000L$$

Owing to the fact that the ends of the inner metal core and the outer metal core are exposed by cutting off the end portion of the sheath member of the cable composed of the plurality of metal cores, submerged in the breaking substance and used as the electrodes, the first discharge breaking system, the second discharge breaking system and the discharge breaking method described above make it unnecessary to adjust a distance between electrodes and facilitate to manufacture the discharge breaking system.

Further, the first and the second discharge breaking systems require no preparation of particular electrodes for manufacturing the discharge breaking system, thereby making it possible to manufacture the discharge breaking system at a low cost. In addition, the voltage level to be applied to electrodes can easily be determined as the distance between the metal cores, that is, the distance between the electrodes is fixed.

Further, a third discharge breaking system according to the present invention has a structure wherein ends of electrodes are connected to each other through a thin metal wire, a capacitor is connected between the other ends of the electrodes and the thin metal wire is submerged in a breaking substance for transmitting a pressure; and is configured to discharge or supply electric energy preliminarily charged or accumulated in the capacitor to the thin metal wire in a short time through the electrodes for fusing-vaporization of the thin metal wire and abrupt vaporization of the breaking substance, thereby breaking an object to be ruptured with an expansion force generating by the vaporization. In this discharge breaking system, an inner metal core and an outer metal core are coaxially disposed and covered with a sheath member to compose a coaxial cable, the inner core and the outer core are used as the electrodes, an end portion of the sheath member is cut off to expose ends of the inner core and the outer core, the exposed ends of the inner core and the outer core are submerged in the breaking substance, and the end of the inner core is wound around the end of the outer core submerged in the breaking substance. The exposed end of the inner core can be provided with one or more notches to make the exposed end like the thin metal wire described above.

Furthermore, a fourth discharge breaking system according to the present invention has a structure wherein the end of the inner core used in the third discharge breaking system is soldered to the end of the outer core submerged in the breaking substance. The exposed end of the inner core could be notched as described above.

The third and fourth discharge breaking systems can be manufactured at low costs owing to the fact that the inner metal core and the outer metal core of the coaxial cable are used as the electrodes, and the end of the inner core which is exposed by cutting off an end portion of a sheath member of a coaxial cable and submerged in a breaking substance is used as a thin metal wire for electrically connecting the inner core submerged in the breaking substance to the outer core. In addition, these discharge breaking systems require no tedious procedures for manufacturing to further reduce the manufacturing costs and permit simplifying structures of the discharge breaking systems.

BEST MODE FOR CARRYING OUT THE INVENTION

The present invention will be described in more details with reference to the accompanying drawings.

Figure 2:
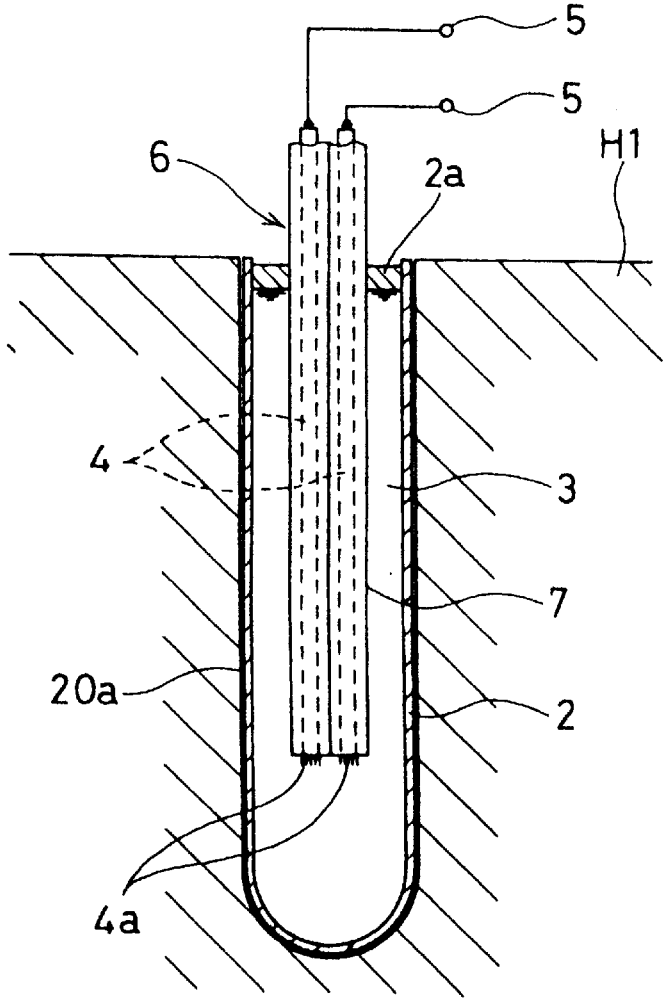
FIG. 2 is a vertical sectional view illustrating, on an enlarged scale, a breaking container used in the first embodiment.
Figure 3:
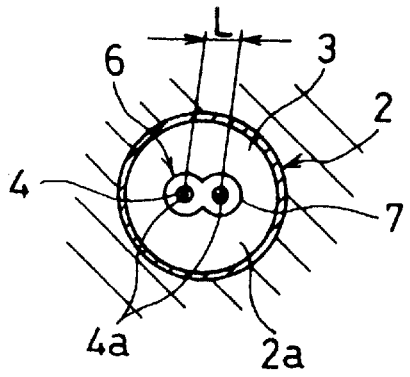
FIG. 3 is a horizontal sectional view illustrating, on an enlarged scale, the breaking container used in the first embodiment.

First, description will be made of a first embodiment of the present invention with reference to FIGS. 1 through 3. A discharge breaking system 1 preferred as the first embodiment of the present invention is used for breakage of an object to be ruptured H1 such as a base rock or a stone to be destroyed or broken into small pieces at a building land, an object to be ruptured for finishing a tunnel or a building to be destroyed.

As shown in the drawings, the discharge breaking system 1 has a breaking container 2 which is fitted in a charging hole 20*a* formed in the object to be ruptured Hi and is filled with a breaking substance 3 for transmitting a pressure. A sealing stopper 2*a* is fitted in the breaking container 2, and a ready-made cable 6 is inserted through the sealing stopper 2*a* and fixed thereto. The cable 6 is composed of a plurality of (two in the drawings) metal cores 4, 4 (made, for example, of Cu) which are disposed in parallel with each other and covered with a sheath member 7 made of synthetic resin.

An end portion of the sheath member is cut off to expose ends of the cores 4, 4, the exposed ends of the cores are submerged into the breaking substance 3 and the ends of the cores submerged in the breaking substance 3 are used as electrodes 4*a*.

The breaking container 2 is made of plastic rubber (synthetic rubber), waterproofed paper or glass.

Further, an energy supply system 9 for supplying electric energy is disposed between the electrodes 4*a*. This energy supply system 9 is composed of a power supply unit 10 which is connected to terminals 5, 5 located at the other ends of the cores 4, 4; a capacitor 13 which is connected in parallel between the power supply unit 10 and the terminal 5, 5; a charging control circuit 11 which is connected between the power supply unit 10 and the capacitor 13 for controlling a quantity of electric energy (charged voltage level) to be accumulated in the capacitor 13; and a discharging switch 12 which is connected between the charging control circuit 11 and one of the terminals 5, 5.

With the discharge breaking system 1, the object to be ruptured is broken by a method described below.

The discharge breaking method comprises steps: to pour the breaking substance 3 into the breaking container 2, to pass the ready-made cable 6 through the sealing stopper 2*a*, to cut off an end portion of the sheath member 7 of the cable 6 to expose ends of the cores 4, 4 and to fit the sealing stopper 2*a* into the breaking container 2, thereby submerging the exposed ends of the cores 4, 4 into the breaking substance 3.

Then, the breaking container 2 is fitted into the charging hole 20*a* formed in the object to be ruptured Hi, the energy supply system 9 is connected to the terminals 5, 5 of the cores 4, 4 and electric energy is accumulated in the capacitor 13.

Figure 4:
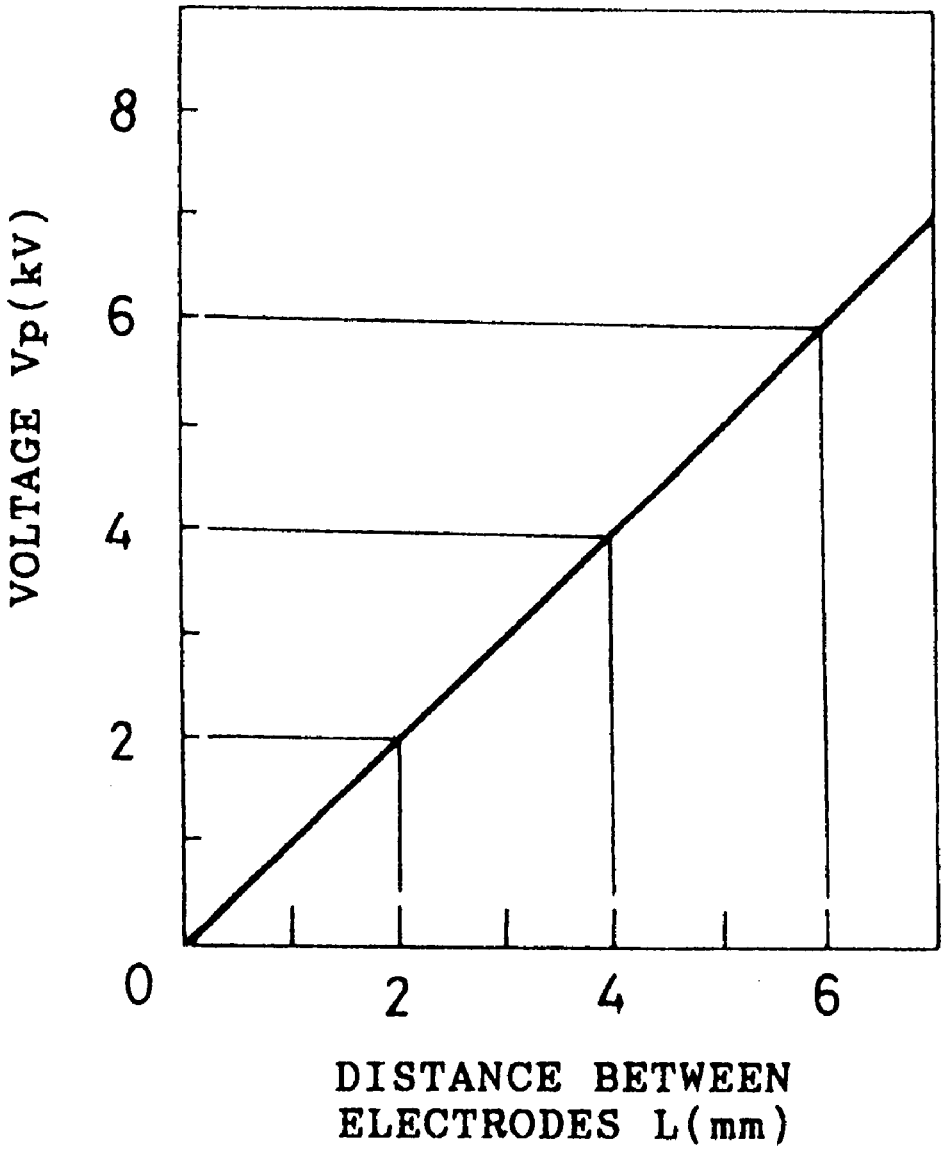
FIG. 4 is a graph illustrating relationship of a distance between electrodes versus an applied voltage required for breakage in the first embodiment.

A graph shown in FIG. 4 which was traced on the basis of experimental results indicates relationship of a distance L (mm) between the electrodes 4*a* versus a minimum voltage Vp (volts) which is to be applied between the electrodes 4*a* for causing electric discharge between the electrodes 4*a*.

From the relationship of the distance L between the electrodes 4*a* versus the voltage Vp required for causing electric discharge between electrodes 4*a* which is visualized by this graph, it was found out that 1000 volts is required for causing electric discharge between the electrodes 4*a* when the distance L between the electrodes 4*a* is a 1 mm, for example. Therefore, it is possible to cause electric discharge when the relationship of the distance L between the electrodes 4*a* versus the voltage Vp satisfies the following equation (1):

$$Vp \geqq 1000L \quad (1)$$

In other words, electric energy should be accumulated in the capacitor 13 until the above-mentioned equation (1) is satisfied.

When the discharging switch 12 is turned on after electric energy is accumulated in the capacitor 13 until the equation (1) is satisfied, electric discharge takes place between the electrodes 4*a* and the breaking substance 3 is abruptly vaporized, whereby the object to be ruptured is broken or embrittled by an expansion force generated by the vaporization.

Owing to the fact that the end portion of the sheath member 7 of the ready-made cable 6 which sustains the cores 4,4 in parallel with each other is cut off to expose the ends of the cores and the exposed ends of the cores 4, 4 are submerged in the breaking substance 3 for use as the electrodes 4*a*, the first embodiment makes it unnecessary for a worker to adjust a distance between the electrodes 4*a* and makes it possible to easily manufacture the discharge breaking system 1 with no skill. Further, the first embodiment requires no preparation of particular electrodes for manufacturing the discharge breaking system 1, thereby making it possible to manufacture the discharge breaking system 1 at a low cost.

Since the ready-make cable 6 has a definite distance L between the electrodes 4*a*, the first embodiment allows electric discharge to take place between the electrodes 4*a* simply by accumulating electric energy in the capacitor 13 until it satisfies the abovementioned equation (1) defining a voltage Vp corresponding to the distance L between the electrodes 4*a* of the cable 6 used and facilitates to control electric energy to be accumulated in the capacitor 13.

Figure 5:
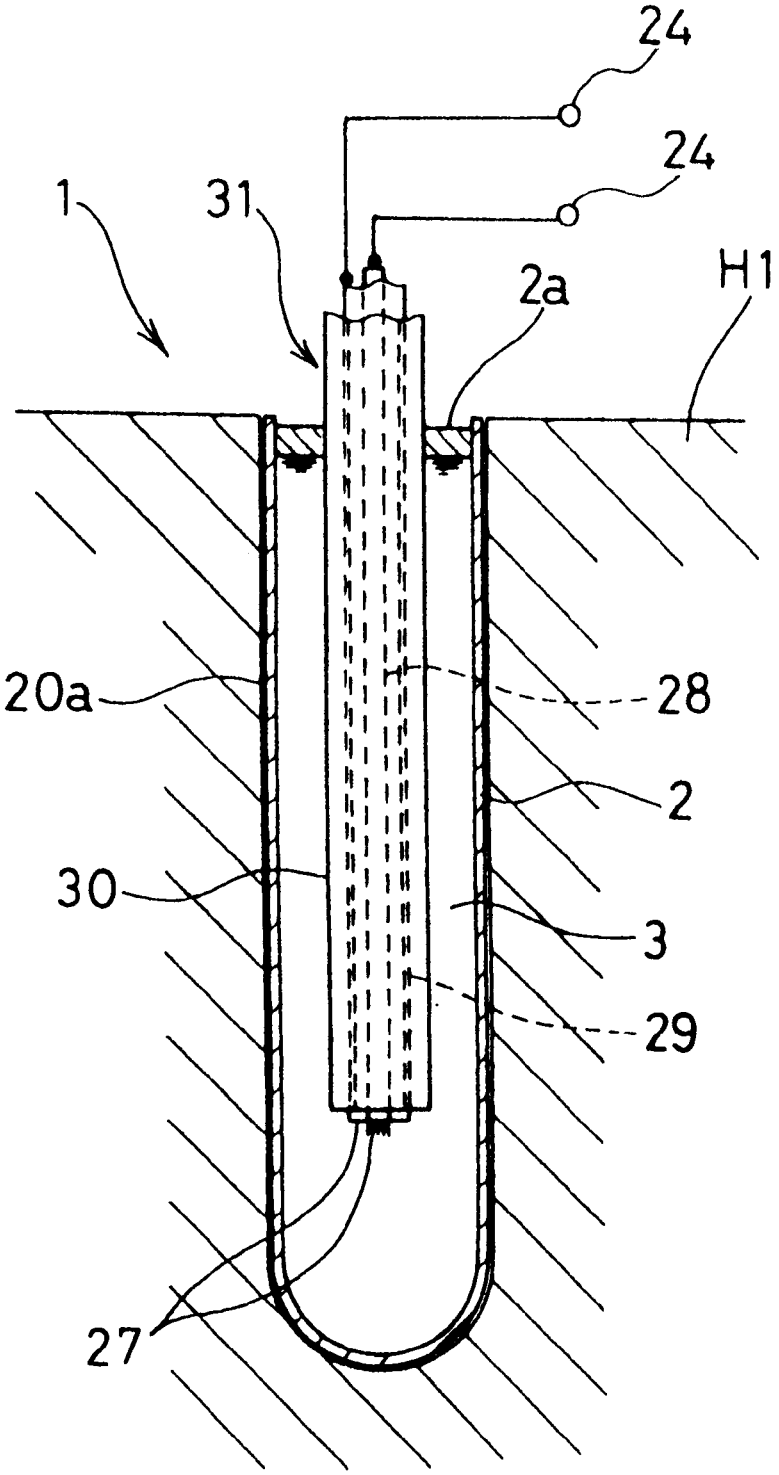
FIG. 5 is a vertical sectional view illustrating, on an enlarged scale, a breaking container used in a second embodiment of the present invention.
Figure 6:
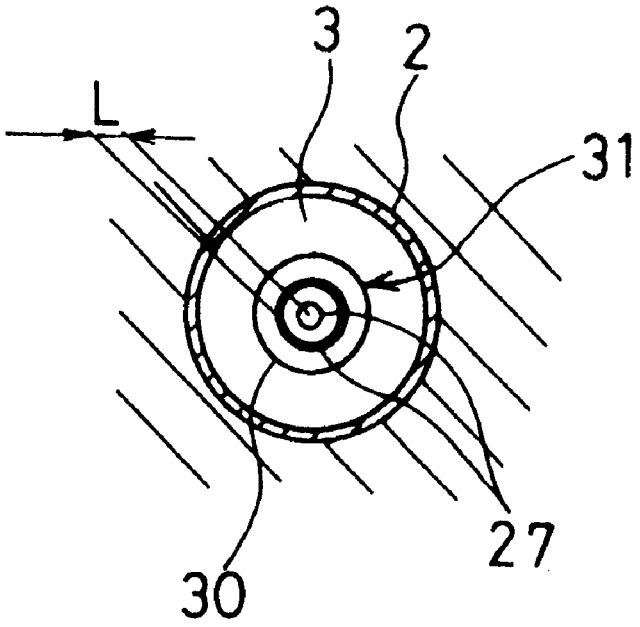
FIG. 6 is a horizontal sectional view illustrating, on an enlarged scale, the breaking container used in the second embodiment.

Then, a second embodiment of the present invention will be described with reference to FIGS. 5 and 6.

In the discharge breaking system preferred as the second embodiment, portions of an inner metal core 28 and an outer metal core (referred to also as a shielding wire) 29 composing a coaxial cable 31 are used as electrodes 27, 27.

The inner core 28 and the outer core 29 are coaxially disposed and covered with a sheath member 30, an end portion of the sheath member 30 is cut off to expose ends of the cores, and the exposed ends are used as electrodes 27, 27.

Like the cable 6 used in the first embodiment described above, the coaxial cable 31 passes though a sealing stopper 2*a* fitted in a breaking container 2 so that the electrodes 27, 27 are submerged in a breaking substance 3 filled in the breaking container 2.

Figure 1:
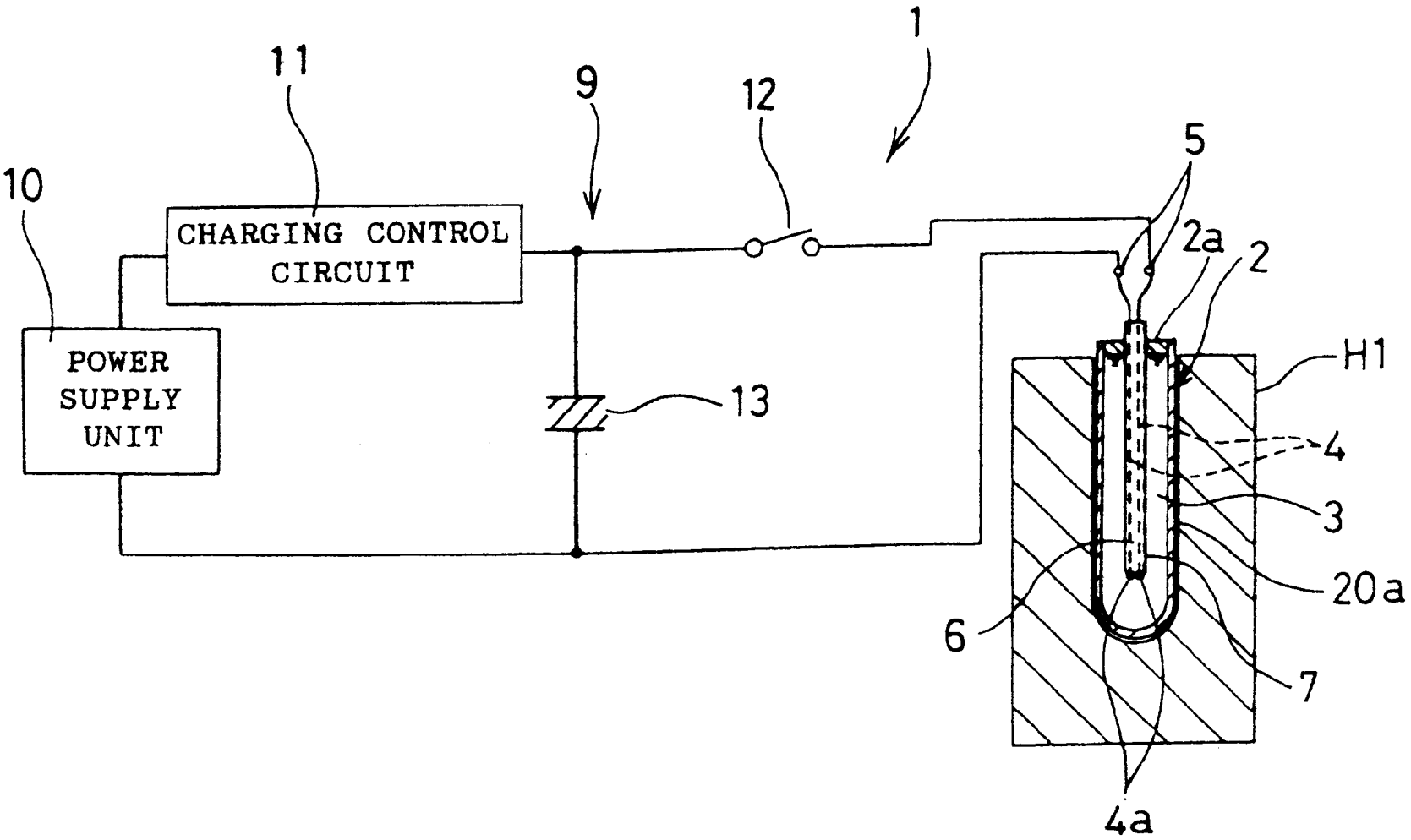
FIG. 1 is a sectional view illustrating an overall configuration of a first embodiment of the discharge breaking system according to the present invention.

Further, an energy supply system 9 which is similar to that shown in FIG. 1 is connected between terminals 24 disposed at the other ends of the cores 28, and 29.

With the discharge breaking system 1 configured as described above, an object to be ruptured H1 is broken by a method which is described below.

The discharge breaking method comprises steps: to pour the breaking substance 3 into the breaking container 2, to pass the coaxial cable 31 through the sealing stopper 2*a*, to cut off an end portion of the sheath member 30 of the coaxial cable 31 to expose ends of the inner core 28 and the outer core 29, and submerge the exposed ends of the inner core 28 and the outer core 29 into the breaking substance 3 by fitting the sealing stopper 2*a* into the breaking container 2.

Subsequently, the breaking container 2 is fitted into a charging hole 20*a* formed in the object to be ruptured H1, and the energy supply system 9 is connected between the terminals of the inner core 28 and the outer core 29. Then, electric energy is accumulated into the capacitor 13 until relationship of the distance between the electrodes 27 versus the voltage Vp which is to be applied between the electrodes 27 satisfies the above-mentioned equation (1).

When a discharging switch 12 is turned on in a condition thus obtained, electric discharge takes place between the electrodes 27 and the breaking substance is abruptly vaporized, whereby the object to be ruptured H1 is broken or embrittled by an expansion force generated by the vaporization. Owing to the fact that the end portion of the sheath member 30 of the ready-made coaxial cable is cut off, and the exposed ends of the inner core 28 and the outer core 29 which are submerged in the breaking substance 3 are used as the electrodes 27, 27, the second embodiment makes it unnecessary for a worker to adjust a distance between the electrodes 27, 27 and the discharge breaking system can easily be manufactured, like the first embodiment, with no skill. Further, the second embodiment described above requires no preparation of particular electrodes for manufacturing the discharge breaking system 1, thereby making it possible to manufacture the discharge breaking system at a low cost and easily control electric energy to be accumulated into the capacitor 13.

Figure 7:
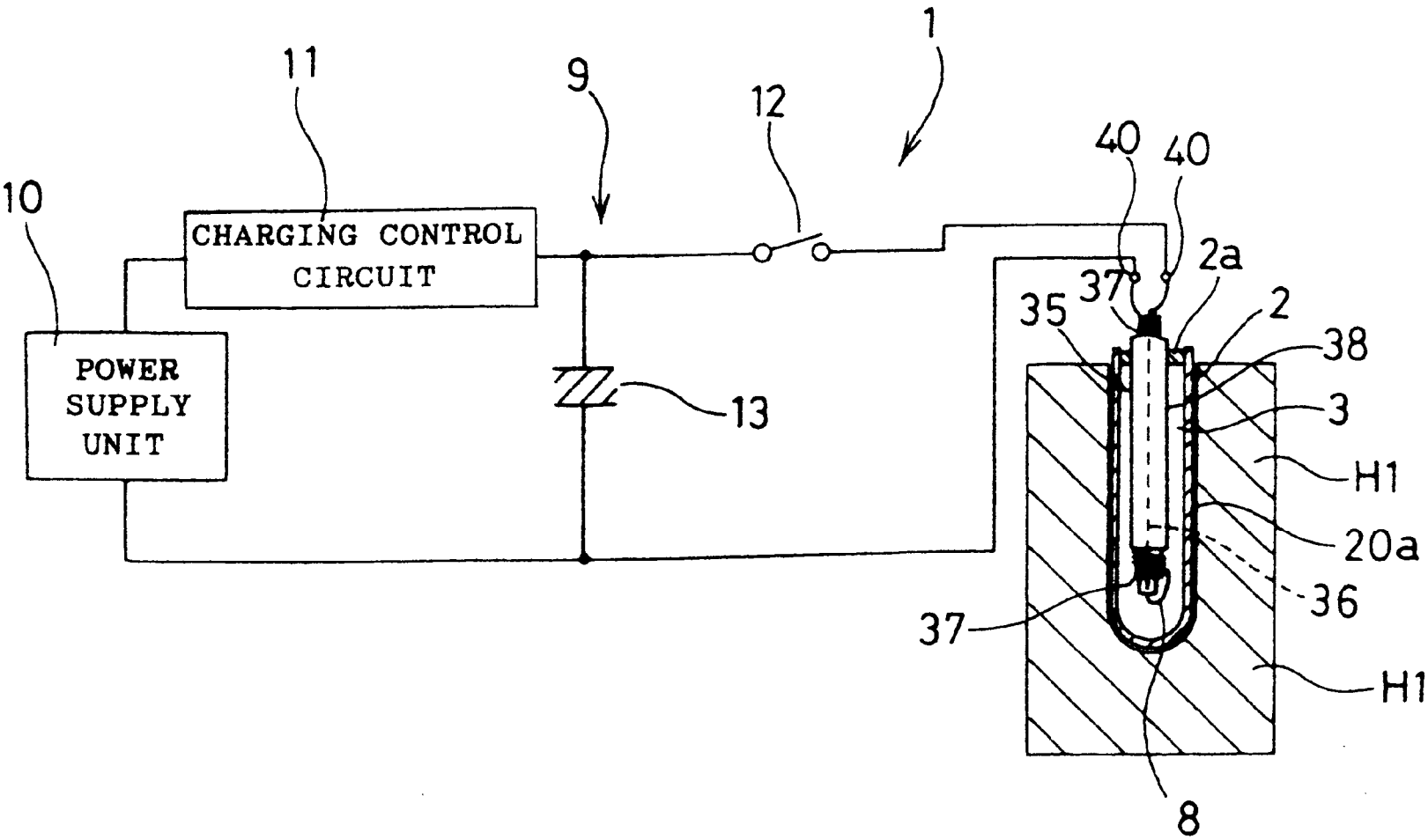
FIG. 7 is a sectional view illustrating an overall configuration of a third embodiment of the discharge breaking system according to the present invention.
Figure 8:
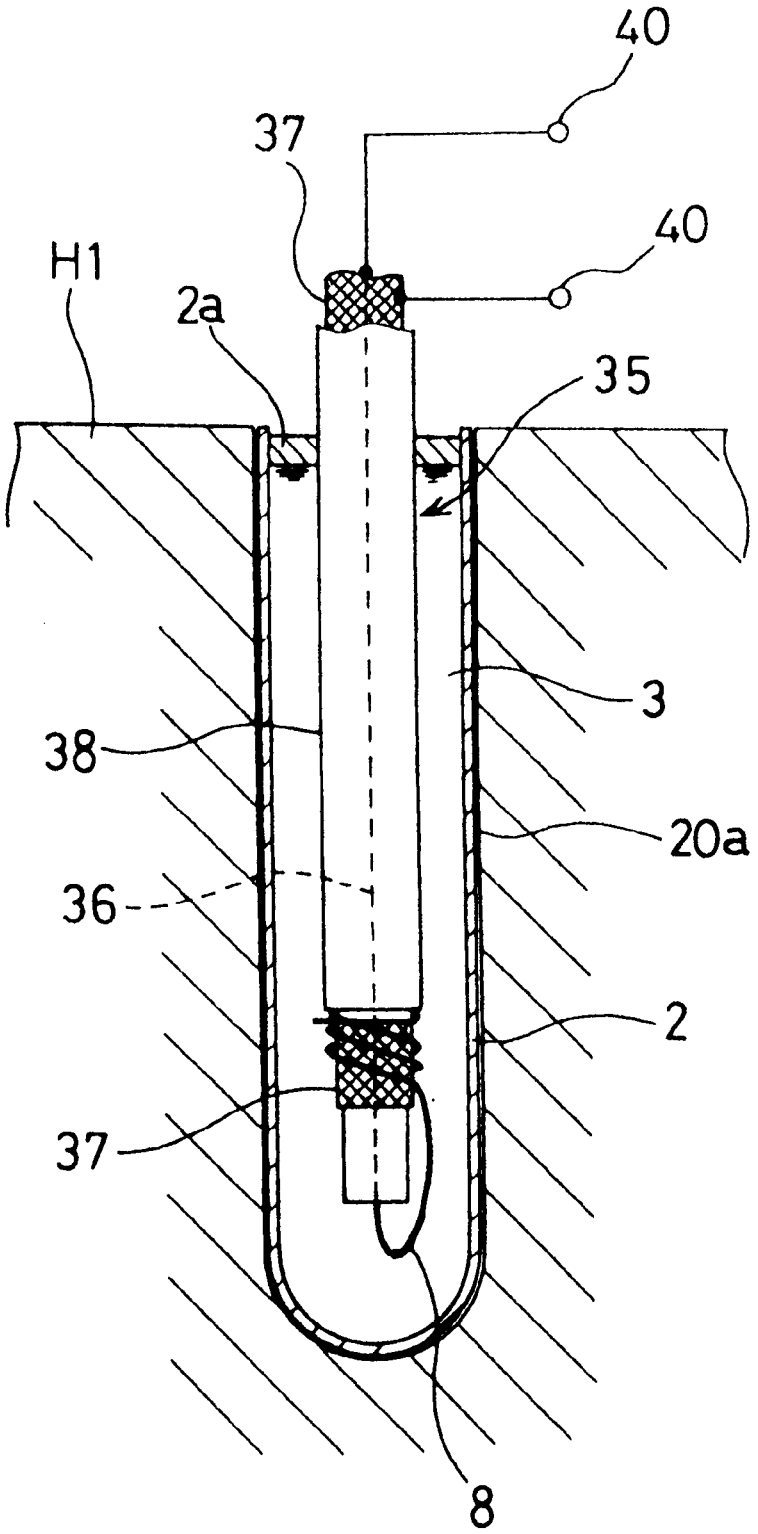
FIG. 8 is a vertical sectional view illustrating, on an enlarged scale, a breaking container used in the third embodiment.
Figure 9:
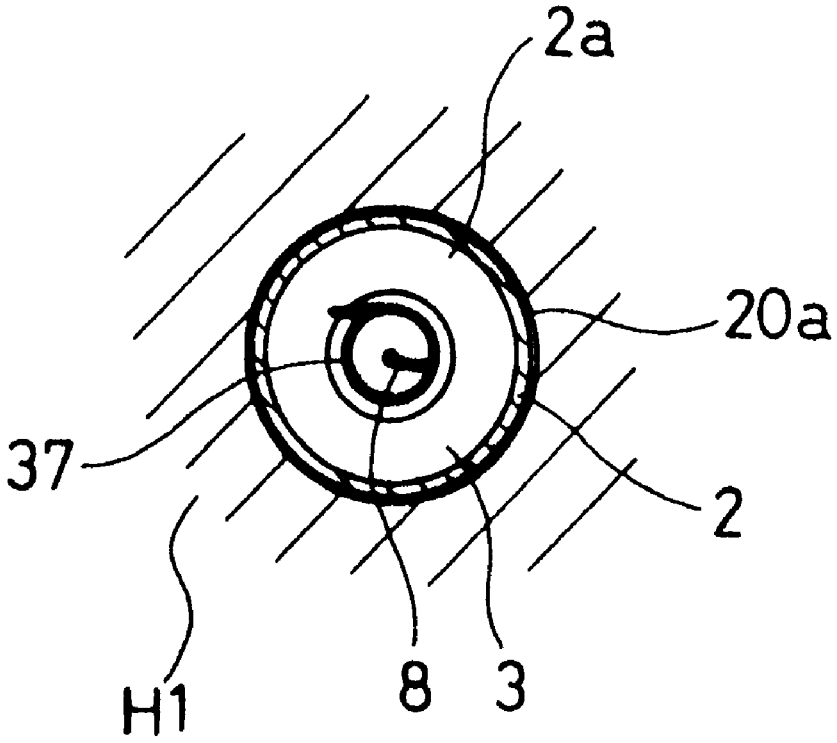
FIG. 9 is a horizontal sectional view illustrating, on an enlarged scale, the breaking container used in the third embodiment.

Now, a third embodiment of the present invention will be described with reference to FIGS. 7 through 9.

A discharge breaking system 1 preferred as the third embodiment has a structure wherein a ready-made coaxial cable 35 passes through a sealing stopper 2*a* of a breaking container 2 filled with a breaking substance 3. The coaxial cable 35 is composed of an inner metal core 36 disposed at a center, an outer core 37 disposed coaxially with the inner core 36, and a sheath member 38 made of synthetic resin which covers the inner core 36 and the outer core 37.

Further, an end portion of the sheath member is cut off to expose ends of the inner core 36 and the outer core 37, the exposed ends of the inner core 36 and the outer core 37 are submerged into the breaking substance 3, the exposed end of the outer core 37 is cut short, the exposed ends of the inner core 36 and the outer core 37 are used as electrodes.

Figure 8A:
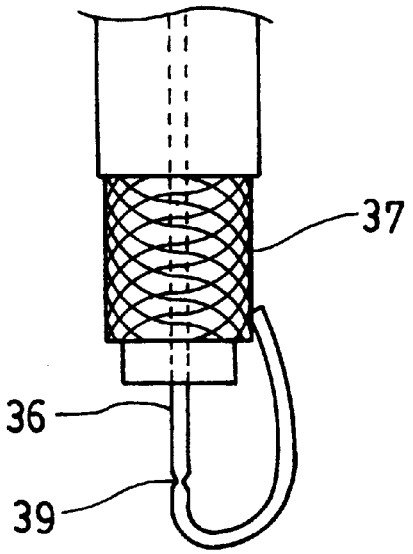
FIG. 8A is a pictorial view of the exposed end of the inner core.

At least one notch is provided in the exposed end of the inner core 36 for reducing the sectional area of the inner core. This is shown in FIG. 8A, which is an enlarged view of a portion of the exposed end of inner core 36. One notch 39 is depicted. The vicinity around the notched portion functions as the above mentioned thin metal wire.

Figure 8B:
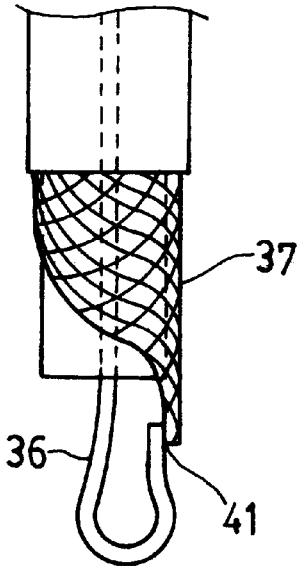
FIG. 8B is a pictorial view of the exposed end of another version of the inner core.

Further, as shown in FIG. 8B, the front end of the exposed end portion of the inner core 36 is connected to the outer core 37 only at a point of contact 41 on the inside of a twisted wire made by twisting the exposed end portion of the outer core. According as required, the front end of the exposed end potion of the inner core and the twisted wire of the exposed portion of the outer core are integrally bound with an adhesive tape or the like so as not to be separated from each other. In addition, the connection between the exposed end portion of the inner core and the exposed end portion of the outer core is effected by simply inserting the front end of the former inside of the latter, which is not depicted in the figure though. The portion of such point contact increases its electric resistance and functions like the above-mentioned notched portion.

The exposed end of the inner core 36 is wound around the outer core 37 for electrical connection thereto and used as a thin metal wire 8.

The third embodiment uses an energy supply system 9 which has a configuration similar to that of the energy supply system used in the first or second embodiment described above. This energy supply system 9 is connected to terminals 40 of the inner core 36 and the outer core 37 protruding from the sealing stopper 2*a*.

With the discharge breaking system 1 structured as described above, an object to be ruptured is broken by a method described below.

The discharge breaking method comprises steps: to pour the breaking substance 3 into the breaking container 2, to pass the coaxial cable through the sealing stopper 2*a*, to cut off the end portion of the sheath member of the coaxial cable 35, to cut short the outer core 37, to wind the inner core 36 around the outer core 37 and to fit the sealing stopper 2*a* into the breaking container 2.

Subsequently, the breaking container 2 is fitted into a charging hole 20*a* formed in an object to be ruptured H1, the energy supply system 9 is connected to the terminals 40 and electric energy is accumulated in the capacitor 13.

When a discharging switch 12 is turned on, the thin metal wire 8 is fused and vaporized, and the breaking substance is abruptly vaporized, whereby the object to be ruptured H1 is broken or embrittled by an expansion force generated by the vaporization.

Owing to the fact that the end portion of the sheath member of the ready-made coaxial cable is cut off to expose the ends of the inner core 36 and the outer core 37, the exposed end of the inner core 36 is used as the thin metal wire 8, and the inner core 36 and the outer core 37, or the electrodes, are electrically connected to each other by winding the exposed end of the inner core 36 around the outer core 37, the third embodiment makes it possible to manufacture the discharge breaking system 1 at a low cost. Further, the third embodiment requires no tedious procedures for manufacturing the discharge breaking system 1 to reduce the manufacturing cost thereof and permits simplifying a structure of the discharge breaking system 1 as a whole.

Figure 10:
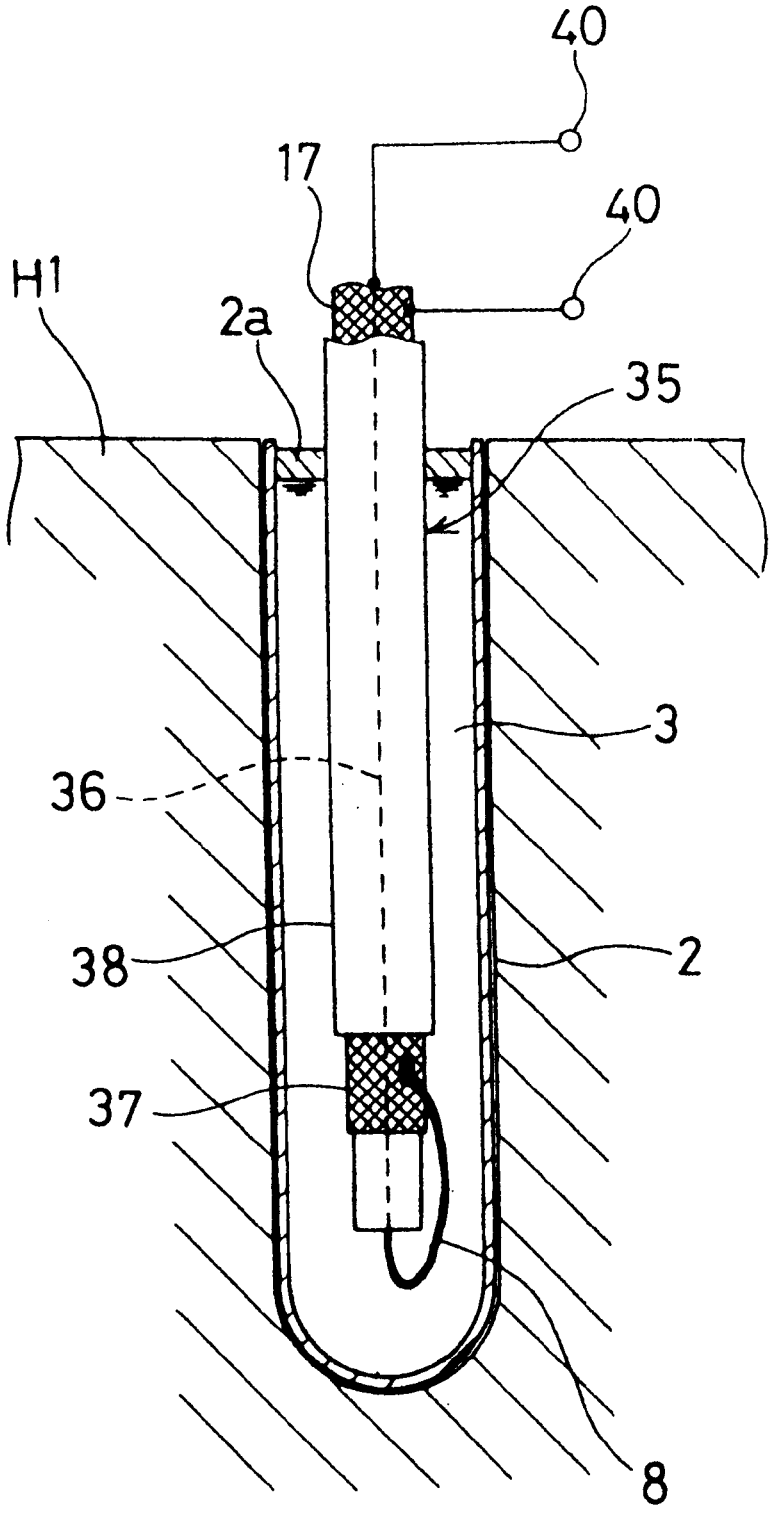
FIG. 10 is a vertical sectional view illustrating, on an enlarged scale, a breaking container used in a fourth embodiment of the present invention.

Finally, description will be made of a fourth embodiment of the present invention with reference to FIG. 10.

A discharge breaking system 1 preferred as the fourth embodiment of the present invention has a structure wherein a ready-made coaxial cable 35 passes through a sealing stopper 2*a* of a breaking container 2, and an end portion of a sheath member 38 of the coaxial cable 35 is cut off to expose ends of an inner core and an outer core, and these exposed ends are submerged in a breaking substance 3.

The exposed end of the outer core 37 is cut short and the exposed end of the inner core 36 is welded or soldered to the outer core 37 for electrical connection so that a middle portion of the exposed end of the inner core 36 serves as a thin metal wire.

One or more notches can be included in the exposed end of inner core 36 as explained above, to render the notched portion to operate as the thin metal wire described earlier. This is shown in FIG. 8A.

Other members of the fourth embodiment are similar to those of the third embodiment described above and will not be described in particular.

Owing to the fact that the end portion of the sheath member of the ready-made coaxial cable 35 is cut off to expose the ends of the inner core 36 and the outer core 37, the exposed end of the outer core 37 is cut short and the exposed end of the inner core 36 is welded or soldered to the outer core 37 for electrical connection so that the middle portion of the exposed end of the inner core 36 serves as the thin metal wire 8, the fourth embodiment makes, like the third embodiment, it possible to manufacture the discharge breaking system at a low cost. Further, the fourth embodiment requires no tedious procedures for manufacturing the discharge breaking system I to reduce the manufacturing cost thereof and permits simplifying a structure of the destruction system as a whole.

Industrial Applicability

As understood from the foregoing description, the discharge breaking system and the discharge breaking method according to the present invention are useful for destruction of base rocks and breakage of stones into small pieces at building lands, breakage for finishing tunnels, and destruction or dismantlement of concrete buildings and so on.

What is claimed is:

1. A discharge breaking system having a structure wherein ends of a plurality of electrodes are connected to each other through a thin metal wire, a capacitor is connected to the other ends of said electrodes and said thin metal wire is submerged in a breaking substance for transmitting a pressure; and configured to break an object to be ruptured with an expansion force generated by fusing-vaporization of said thin metal wire and abrupt vaporization of said breaking substance which are caused by supplying or discharging electric energy preliminarily charged or accumulated in said capacitor to said thin metal wire through said electrodes in a short time, characterized in that an inner metal core and an outer metal core of a coaxial cable composed of said inner metal core and said outer metal core which are coaxially disposed and covered with a sheath member are used as said electrodes, an end portion of said sheath member is cut off to expose ends of said inner core and said outer core, the exposed ends of said inner core and said outer core are submerged in said breaking substance, and the exposed end of said inner core has a portion of smaller cross section than the remainder of said inner metal core and is connected to the exposed end of said outer core so that the exposed end of said inner core serves as said thin metal wire.

2. A discharge breaking system according to claim 1 characterized in that the exposed end of said inner core is wound around the exposed end of said outer core.

3. A discharge breaking system according to claim 1 characterized in that the exposed end of said inner core is welded to the exposed end of said outer core.

4. A discharge breaking system according to claim 1 characterized in that the exposed end of said inner core is soldered to the exposed end of said outer core.

5. A discharge breaking system according to claim 1 wherein the voltage Vp required for causing electric discharge between the exposed ends of said inner core and said outer core is at least 1000 times the distance L between said exposed ends, according to the relationship:

$$Vp \geqq 1000L \text{ (mm)}.$$

6. A discharge breaking system according to claim 1 wherein the exposed end of said inner core has at least one notch for causing the exposed end to function as said thin metal wire.

7. A discharge breaking system according to claim 1 wherein the front end of the exposed end portion of the inner core is connected to the exposed end portion of the outer core only through a point contact.

* * * * *

UNITED STATES PATENT AND TRADEMARK OFFICE

CERTIFICATE OF CORRECTION

PATENT NO. : 6,283,555 B1
DATED : September 4, 2001
INVENTOR(S) : Hiroaki Arai and Hidehiko Maehata It is certified that error appears in the above-identified patent and that said Letters Patent is hereby corrected as shown below:

Title page,
Item [63], under "Related U.S. Application Data," the filing date of the PCT application is -- Jul. 22, 1996 --.

Signed and Sealed this

Second Day of April, 2002

*Attest:*

*Attesting Officer*

JAMES E. ROGAN
*Director of the United States Patent and Trademark Office*